United States Patent [19]

Dick et al.

[11] 3,993,929

[45] Nov. 23, 1976

[54] AUTOMATIC CORRECT EXPOSURE INDICATOR

[75] Inventors: John D. Dick, Denver; Dennis J. Wilwerding, Littleton, both of Colo.

[73] Assignee: Honeywell Inc., Minneapolis, Minn.

[22] Filed: Dec. 19, 1975

[21] Appl. No.: 642,283

[52] U.S. Cl. ..... 315/241 P; 315/134; 315/135; 315/151; 340/248 A; 354/33; 354/128

[51] Int. Cl.[2] ..... H05B 41/32

[58] Field of Search ..... 315/241 P, 151, 157, 315/159, 129, 134–136; 354/32, 33, 35, 127, 128, 145; 320/1; 340/221, 248 A

[56] References Cited

UNITED STATES PATENTS

| | | | |
|---|---|---|---|
| 3,310,723 | 3/1967 | Schmidt et al. | 320/1 |
| 3,586,906 | 6/1971 | Okuno et al. | 315/241 P X |
| 3,706,911 | 12/1972 | Wilwerding | 315/151 X |

*Primary Examiner*—Eugene La Roche
*Attorney, Agent, or Firm*—David R. Fairbairn

[57] ABSTRACT

A correct exposure annunciator for electronic flash apparatus includes an indicator which is turned on when the voltage on a capacitor is less than a predetermined value. The capacitor is discharged in response to a control signal which indicates that proper exposure has occurred. The capacitor is then recharged until the voltage on the capacitor attains the predetermined value and turns off the indicator.

17 Claims, 1 Drawing Figure

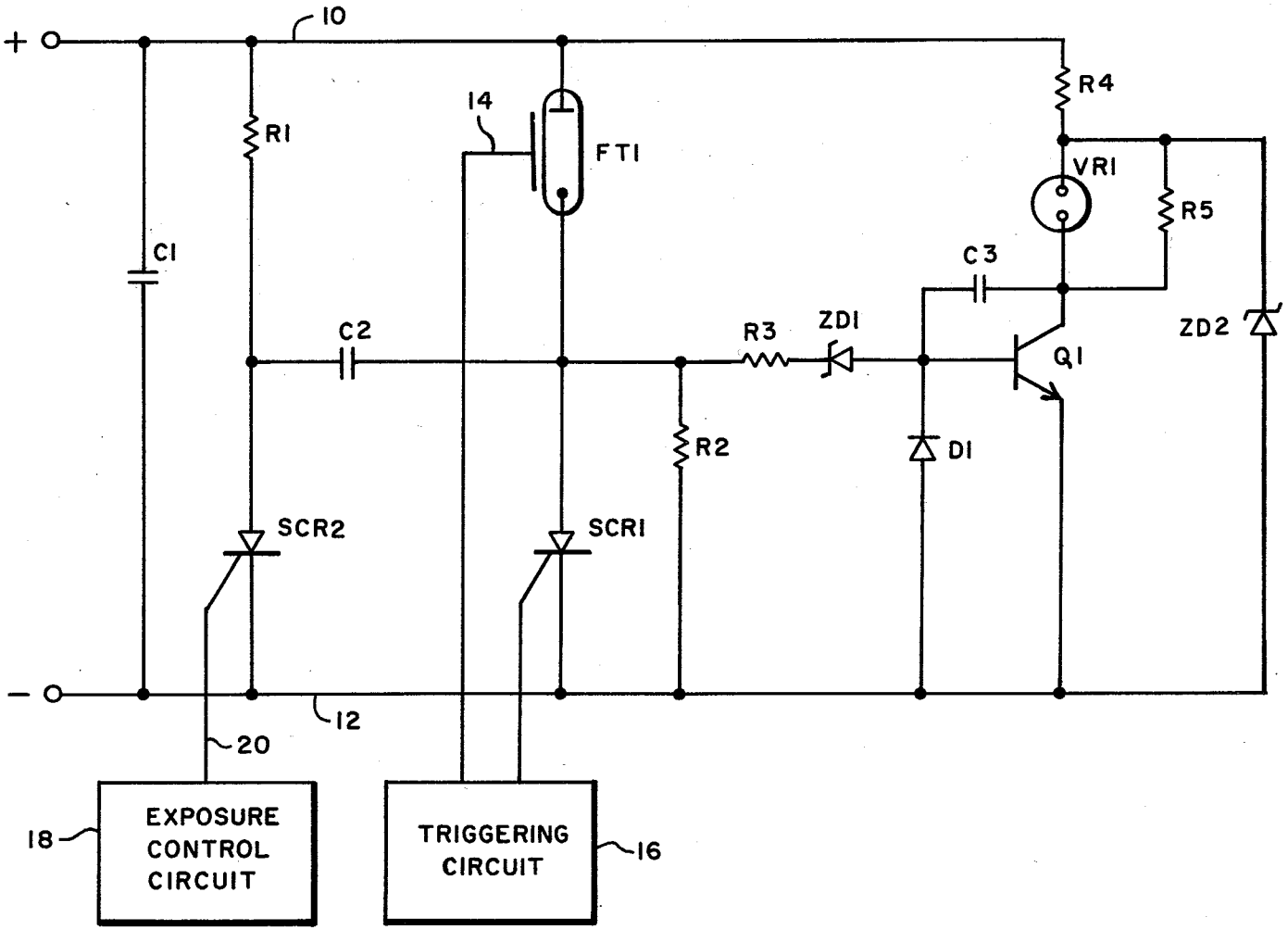
ZD2
R5
R4
VR1
Q1
C3
D1
ZD1
R3
R2
FT1
SCR1
14
16
TRIGGERING CIRCUIT
10
C2
12
R1
SCR2
20
EXPOSURE CONTROL CIRCUIT
C1
+
−
18

AUTOMATIC CORRECT EXPOSURE INDICATOR

REFERENCE TO CO-PENDING APPLICATIONS

Reference is made to co-pending applications by D. J. Wilwerding entitled "Remote Light Sensor for Electronic Flash Units" (Ser. No. 642,282), and "Extended Range Correct Exposure Annunciator" (Ser. No. 642,281), which were filed on even date herewith and are assigned to the same assignee.

BACKGROUND OF THE INVENTION

The present invention relates to automatic electronic or "computer" flash systems. In particular, the present invention relates to an automatic correct exposure annunciator for use with automatic electronic flash systems.

Automatic electronic flash systems include a light producing means, generally a flash tube, which is actuated to illuminate a scene being photographed. A light sensing or exposure control circuit detects the scene illumination and actuates a light terminating or light quenching means when sufficient light has been produced to properly expose a light sensitive film of an associated camera.

There is need for an annunciator which will indicate to the photographer whether sufficient light has been produced to properly expose the film. In U.S. Pat. No. 3,706,911 by Dennis J. Wilwerding, a correct exposure annunciator circuit is described which includes a switch responsive to the operation of the light quenching means. The closure of this switch energizes the annunciator. A reset switch is used to turn off the annunciator.

Although the correct exposure annunciator circuit of the Wilwerding patent is generally satisfactory, it does have some shortcomings. In particular, it typically requires a relatively large number of additional components (12 to 15 components in many cases). This increases cost and affects reliability of the flash system.

In U.S. patent applications Ser. Nos. 603,565 by James R. Adams, Jr. and Dennis J. Wilwerding and 603,564 by James R. Adams, Jr., improved correct exposure annunciators are described. These applications were filed Aug. 11, 1975 and are assigned to the same assignee as the present application. The referenced patent applications reduce the number of components required for a correct exposure annunciator. This results in lower cost and higher reliability of the annunciator circuit.

Although the annunciators described in the referenced patent application are generally satisfactory, there remains a need for other correct exposure annunciator circuits. For example, a correct exposure annunciator which uses low cost components, which does not require a separate power supply, and which remains lit for a relatively long period of time before being automatically terminated is desirable.

SUMMARY OF THE INVENTION

The automatic correct exposure annunciator of the present invention includes indicator means which is operable when the voltage on a capacitor is less than a predetermined value. The capacitor is discharged in response to a control signal, thereby causing the indicator means to operate. The capacitor is then recharged while the indicator is operating until the voltage on the capacitor reaches or exceeds the predetermined value required to turn off the indicator. The time period during which the indicator operates is determined, therefore, by the charging time of the capacitor.

BRIEF DESCRIPTION OF THE DRAWING

The FIGURE shows electronic flash apparatus including the automatic correct exposure annunciator of the present invention.

DETAILED DESCRIPTION OF THE PREFERRED EMBODIMENTS

The FIGURE shows a preferred embodiment of the present invention. The electronic flash apparatus of the FIGURE includes conductor 10, which is connected to a positive terminal, and conductor 12, which is connected to a negative terminal. The positive and negative terminals are adapted to be connected to the usual capacitor charging means (not shown) which are used in conjunction with electronic flash apparatus.

Flash storage capacitor C1 is connected between conductors 10 and 12. Also connected between conductors 10 and 12 is the series connection of flash tube FT1 and flash termination switch SCR1. As shown in the FIGURE, flash termination switch SCR1 may be a semiconductor switching device such as a silicon controlled rectifier. The anode of flash tube FT1 is connected to conductor 10 and the cathode of FT1 is connected to the anode of SCR1. The cathode of SCR1 is connected to conductor 12.

In order to initiate a light flash, a triggering signal is applied to the triggering terminal 14 of FT1 and to the gate of SCR1. This triggering signal is produced by triggering circuit 16, which may take one of many well know forms. Examples of triggering circuits which may be used are shown in U.S. Pat. Nos. Re 28,025 by Murata et al and 3,809,954 by Engelstatter.

An exposure control circuit 18 receives light reflected from the scene which is illuminated by the flash. When the total light received by exposure control circuit 18 exceeds a predetermined desired value, exposure control circuit 18 produces a terminating signal at terminal 20. Exposure control circuit 18 may take one of many well known forms and is preferably of the general type described in U.S. Pat. Nos. Re 26,999 by F. P. Elliott and 3,519,879 by F. T. Ogawa.

The FIGURE includes a terminating circuit for turning off SCR1 and thus terminating the light flash in response to the terminating signal at terminal 20. The terminating circuit, which includes resistors R1 and R2, commutation capacitor C2, and commutation switch SCR2, turns off SCR1 by the well known commutation technique. A light flash which is terminated by commutation will hereafter be referred to as a "commutated flash".

Commutation switch SCR2 is, like SCR1, preferably a semiconductor switching device such as a silicon controlled rectifier. The gate of SCR2 is connected to terminal 20 to receive the terminating signal. The cathode of SCR2 is connected to conductor 12, and the anode of SCR2 is connected to one terminal of commutation capacitor C2. The other terminal of commutation capacitor C2 is connected to the anode of SCR1.

Commutation capacitor C2 is charged through a charging circuit which includes resistor R1, commutation capacitor C2, and resistor R2. One terminal of resistor R1 is connected to conductor 10, and the other terminal of R1 is connected to the junction of the anode SCR2 and the one terminal of C2. Resistor R2 is connected between the anode and cathode of SCR1.

The automatic correct exposure annunciator of the present invention includes resistors R3, R4, and R5, zener diodes ZD1 and ZD2, transistor Q1, capacitor C3, diode D1, and indicator lamp VR1. The base of transistor Q1 is connected to the anode of termination switch SCR1 through anode-to-cathode zener diode ZD1 and resistor R3. Resistor R4, indicator lamp VR1, and the collector-emitter path of Q1 form a series current path between conductors 10 and 12. Zener diode ZD2 is connected in parallel with VR1 and the collector - emitter path of Q1. The anode of ZD2 is connected to conductor 12, and the cathode of ZD2 is connected to the junction of VR1 and resistor R4. Resistor R5 is connected to the junction of VR1 and resistor R4. Resistor R5 is connected in parallel with VR1. Miller capacitor C3 is connected between the base and collector of transistor Q1. Protective diode D1 is connected between base and emitter of Q1, with the anode of D1 connected to the emitter of Q1 and the cathode of D1 connected to the base of Q1.

The operation of the electronic flash apparatus shown in the FIGURE is generally as follows. Capacitor C1 is charged to a relatively high voltage by the usual capacitor charging means. Capacitor C1 is a source of energy to the electronic flash apparatus during the production of the light flash and to the annunciator circuit immediately after production of the light flash.

To initiate a flash, the user closes contacts (not shown) which form a part of triggering circuit 16. Triggering circuit 16 produces the triggering signal at triggering terminal 14 of flash tube and at the gate of SCR1. The triggering signal causes FT1 and SCR1 to turn on, and FT1 begins to produce the light flash.

Once FT1 and SCR1 have been triggered on and light is being produced by FT1, exposure control circuit 18 begins to sense the light reflected from the object being illuminated. When the total light received by exposure control circuit 18 reaches a predetermined desired value, a terminating signal is produced at terminal 20. This terminating signal is applied to the gate of SCR2, thereby turning SCR2 on.

When commutation switch SCR2 is turned on, the voltage across commutation capacitor C2 is applied to anode - cathode of SCR1, thereby reducing the voltage at the anode of SCR1. This reduction in voltage at the anode of SCR1 turns off SCR1, thereby terminating the light flash. The process of turning off SCR1 by reducing the voltage at the anode of SCR1 is termed "commutation".

The correct exposure annunciator circuit of the present invention operates as a result of commutation. Prior to commutation, C3 is charged positive through a current path including R4, R5, ZD1, R3, and R2. Q1 is turned off by virtue of no base current. Indicator VR1, therefore, is turned off.

Q1 is turned on and VR1 is ignited by the large positive voltage pulse that is impressed at the anode of SCR1 after SCR1 turns off. This voltage pulse occurs because current continues to flow through FT1 into capacitor C2 until FT1 extinguishes. This current is coupled through R3 and ZD1 and is of sufficient magnitude and duration to discharge capacitor C3 and turn on transistor Q1.

As Q1 turns on, VR1 ignites, thereby indicating that commutation has occurred. When the current to the base of Q1 ceases, the Miller coupling of C3 prevents an immediate turn-off of Q1. Instead, the voltage at the collector of Q1 begins to rise gradually due to the Miller coupling and recharging of C3. Indicator lamp VR1 extinguishes when the voltage across the collector - emitter of Q1 plus the maintaining voltage of VR1 equals the zener voltage of ZD2. The "maintaining voltage" of VR1 is the minimum voltage required to maintain VR1 in a conductive (and, therefore, light-emitting) state.

Several modifications and variations to the present invention are possible. First, although the voltage at the anode of SCR1 has been used to provide a control signal for the annunciator circuit, any other source of a control signal which indicates correct exposure or termination of the flash as a result of sufficient amount of light by the exposure control circuit may be used.

Second, transistor Q1 may be replaced by another form of switching means which has a control electrode and first and second main current carrying electrodes. The control electrodes of the switching means is connected to a source of the control signal.

Third, different connections of capacitor C3, such as between the collector and emitter of Q1, are possible. One feature of the present invention is that the indicator, VR1, operates only when the voltage on C3 is less than a first predetermined value. The present invention, therefore, includes means to discharge capacitor C3 in response to the control signal to a voltage less than the first predetermined value and means to recharge C3 while indicator VR1 is turned on. VR1 is turned off when the voltage across C3 attains the first predetermined value.

Fourth, zener diode ZD2 may be replaced by any suitable potential limiting means which limits the sum of the potentials across VR1 and collector - emitter of Q1 (and, therefore, the voltage across C3) to a second predetermined value.

In conclusion, the present invention is a highly advantageous correct exposure annunciator for automatic electronic flash systems. The present invention provides a reliable indication of correct exposure with a minimum of additional components. These additional components are low in cost. A separate voltage source is not necessary since main flash capacitor C1 is used in the energization circuit. The operation of the indicator lamp is automatically terminated after a predetermined time period, thereby eliminating the need for any mechanical or manual reset switch.

Although the present invention has been described with reference to preferred embodiments, workers skilled in the art will recognize that changes in form and details may be made without departing from the spirit and scope of the present invention.

The embodiments of the invention in which an exclusive property or right is claimed are defined as follows:

1. In electronic flash apparatus, annunciator means for providing, in response to a control signal, an indication of an occurrence, the annunciator means comprising:

capacitor means;

indicator means selectively operable to an energized condition indicative of the occurrence when voltage on the capacitor means is less than a first predetermined value;

discharge means for discharging the capacitor means in response to the control signal to a voltage less than the first predetermined value; and charging means for charging the capacitor means, when the indicator means is in the energized condition indicative of the occurrence, to a voltage equal to or greater than the first predetermined value.

2. The invention of claim 1 wherein the discharge means comprises switching means for switching from a non-conductive to a conductive state in response to the control signal.

3. The invention of claim 2 wherein the switching means has a control electrode and first and second main current carrying electrodes, the control electrode for receiving the control signal.

4. The invention of claim 3 wherein the indicator means is connected in series in an energization circuit with the first and second main current carrying electrodes.

5. The invention of claim 4 and further comprising voltage limiting means for limiting the voltage across the indicator means and the first and second main current carrying electrodes to a second predetermined value greater than the first predetermined value.

6. The invention of claim 5 wherein the capacitor means has a terminal connected to one of the main current carrying electrodes.

7. The invention of claim 6 wherein the voltage on the capacitor means determines the voltage across the first and second main current carrying electrodes.

8. The invention of claim 7 wherein the switching means comprises transistor means and wherein the control electrode is a base electrode of the transistor means and wherein the first and second main current carrying electrodes are collector and emitter electrodes of the transistor means.

9. The invention of claim 8 wherein the capacitor means is connected between the base electrode and the collector electrode of the transistor means.

10. The invention of claim 9 wherein the voltage limiting means comprises zener diode means connected across the series connection of the indicator means and collector - emitter of the transistor means.

11. Annunciator means for use with electronic flash apparatus, the annunciator means comprising:

switching means having a control electrode and first and second main current carrying electrodes, the switching means for switching from a non-conductive to a conductive state in response to a control signal;

indicator means connected in an energization circuit with the first and second main current carrying electrodes, the indicator means requiring an indicator voltage greater than a maintaining voltage in order to operate;

voltage limiting means for limiting the voltage across the indicator means and the first and second main current carrying electrodes to a predetermined value greater than the maintaining voltage; and turn-off capacitor means for increasing, after the indicator means is turned on, the potential across the first and second main current carrying electrodes until the indicator voltage is less than the maintaining voltage.

12. The invention of claim 11 wherein the switching means comprises transistor means having a base electrode as the control electrode, and collector and emitter electrodes as the first and second main current carrying electrodes.

13. The invention of claim 12 wherein the turn-off capacitor means has a first terminal connected to the collector electrode of the transistor means.

14. The invention of claim 13 wherein the turn-off capacitor means has a second terminal connected to the base electrode of the transistor means.

15. The invention of claim 14 wherein the indicator means comprises light emitting means having first and second electrodes.

16. The invention of claim 15 wherein the second electrode of the light emitting means is connected to the electrode of the transistor means.

17. The invention of claim 16 wherein the voltage limiting means comprises zener diode means connected between the first electrode of the light emitting means and the emitter electrode of the transistor means.

* * * * *